US011094196B2

(12) United States Patent
Kim et al.

(10) Patent No.: US 11,094,196 B2
(45) Date of Patent: Aug. 17, 2021

(54) APPARATUS AND METHOD FOR CONTROLLING A REAR CROSS TRAFFIC ALERT

(71) Applicant: Mando Corporation, Pyeongtaek-si (KR)

(72) Inventors: Jae Suk Kim, Yongin-si (KR); Tae Bong Noh, Yongin-si (KR)

(73) Assignee: Mando Corporation, Pyeongtaek-si (KR)

( * ) Notice: Subject to any disclaimer, the term of this patent is extended or adjusted under 35 U.S.C. 154(b) by 0 days.

(21) Appl. No.: 16/710,530

(22) Filed: Dec. 11, 2019

(65) Prior Publication Data

US 2020/0193830 A1 Jun. 18, 2020

(30) Foreign Application Priority Data

Dec. 12, 2018 (KR) ..... 10-2018-0159620

(51) Int. Cl.
*G08B 21/00* (2006.01)
*G08G 1/16* (2006.01)
*G08G 1/04* (2006.01)

(52) U.S. Cl.
CPC ..... *G08G 1/166* (2013.01); *G08G 1/04* (2013.01)

(58) Field of Classification Search
CPC ..... G08G 1/04; G08G 1/166; G08G 1/168
USPC ..... 340/901
See application file for complete search history.

(56) References Cited

U.S. PATENT DOCUMENTS

| | | | | |
|---|---|---|---|---|
| 9,064,408 | B2 * | 6/2015 | Komoguchi | B60Q 9/006 |
| 9,599,706 | B2 | 3/2017 | Zeng et al. | |
| 9,630,556 | B2 | 4/2017 | Max et al. | |
| 2007/0279199 | A1 * | 12/2007 | Danz | G08G 1/168 340/435 |
| 2008/0306666 | A1 * | 12/2008 | Zeng | B60Q 9/006 701/70 |
| 2010/0271238 | A1 * | 10/2010 | Reed | G01S 13/931 340/932.2 |

FOREIGN PATENT DOCUMENTS

| | | | |
|---|---|---|---|
| KR | 10-2015-0028492 | A | 3/2015 |
| KR | 10-2017-0087368 | A | 7/2017 |

* cited by examiner

*Primary Examiner* — Mark S Rushing
(74) *Attorney, Agent, or Firm* — Morgan, Lewis & Bockius LLP

(57) ABSTRACT

An apparatus for controlling a rear cross traffic alert includes: a parking form determiner that determines a parking form of a vehicle using at least one of sensing information or parking space information; a reference angle setter that sets a reference angle for controlling a rear cross traffic alert in accordance with the parking form; and a traffic alert controller that controls generation/non-generation of a traffic alert using a result of comparison between an incidence angle, which is formed by a movement path of another vehicle detected inside a rear cross traffic alert area of the vehicle and a longitudinal reference line of the vehicle, and the reference angle if a rear cross traffic alert start condition of the vehicle is satisfied.

20 Claims, 11 Drawing Sheets

APPARATUS AND METHOD FOR CONTROLLING A REAR CROSS TRAFFIC ALERT

CROSS-REFERENCE TO RELATED APPLICATION

This application claims priority from Korean Patent Application No. 10-2018-0159620, filed on Dec. 12, 2018, which is hereby incorporated by reference for all purposes as if fully set forth herein.

BACKGROUND OF THE INVENTION

Field of the Invention

The present disclosure relates to an apparatus and a method for controlling a rear cross traffic alert of a vehicle. In more detail, the present disclosure relates to a method and an apparatus for detecting an obstacle on the rear side of a parked vehicle and performing a traffic alert in a dangerous situation. Generally, in a situation in which a host vehicle is parked in a direction that is orthogonal or diagonal with respect a vehicle passage direction, when the host vehicle moves backward so as to exit from a parking zone, in consideration of a case in which a driver cannot check an approaching target vehicle in the middle of driving in the vehicle passage direction with naked eyes due to a vehicle parked next to the host vehicle or the like, a vehicle rear cross radar performs a rear cross traffic alert function.

Description of Related Art

However, a target vehicle may approach on the rear side of the vehicle in various paths, and thus, in a case in which the target vehicle approaches at an angle similar to that of the host vehicle, it may be difficult for a conventional rear cross traffic alert apparatus to perform accurate detection thereof. In other words, a conventional rear cross traffic alert apparatus does not provide a rear cross traffic alert due to erroneous detection and the accuracy of the traffic alert in a case in which a target vehicle moves at a predetermined angle.

In a case in which a traffic alert is not provided in a case in which a target vehicle moves at a predetermined angle like a conventional rear cross traffic alert apparatus, a problem in which a driver may neglect monitoring of the rear side depending on the rear cross traffic alert apparatus may occur, and a problem in which a target vehicle may be excluded from a traffic alert target also in the case of general lateral target vehicle driving in the case of diagonal parking or the like may occur.

SUMMARY OF THE INVENTION

From the background described above, the present disclosure proposes an apparatus and a method for controlling a rear cross traffic alert that set a traffic alert condition for a rear cross traffic alert to be changeable in accordance with a parking form of a vehicle.

In addition, the present disclosure proposes a method and an apparatus for improving reliability by setting a reference angle to be changeable in accordance with a parking form of a vehicle and accurately detecting a traffic alert target of the rear cross side even in a situation of diagonal parking.

An embodiment for solving the problems described above provides a rear cross traffic alert control apparatus including:

a parking form determiner that determines a parking form of a vehicle using at least one of sensing information or parking space information; a reference angle setter that sets a reference angle for controlling a rear cross traffic alert in accordance with the parking form; and a traffic alert controller that controls generation/non-generation of a traffic alert using a result of comparison between an incidence angle, which is formed by a movement path of another vehicle detected inside a rear cross traffic alert area of the vehicle and a longitudinal reference line of the vehicle, and the reference angle if a rear cross traffic alert start condition of the vehicle is satisfied.

In addition, one embodiment provides a method for controlling a rear cross traffic alert, the method including: a parking form determining step of determining a parking form of a vehicle using at least one of sensing information or parking space information; a reference angle setting step of setting a reference angle for controlling a rear cross traffic alert in accordance with the parking form; and a traffic alert control step of controlling generation/non-generation of a traffic alert using a result of comparison between an incidence angle, which is formed by a movement path of another vehicle detected inside a rear cross traffic alert area of the vehicle and a longitudinal reference line of the vehicle, and the reference angle if a rear cross traffic alert start condition of the vehicle is satisfied.

As described above, according to the present disclosure, there is an advantage of providing a rear cross traffic alert function having high reliability regardless of a parking form of a vehicle. In addition, according to the present disclosure, there are advantages of providing the same rear cross traffic alert function as those in other parking situations also in a situation of diagonal parking of the vehicle and improving driver's convenience and reliability.

DETAILED DESCRIPTION OF THE INVENTION

Figure 1:
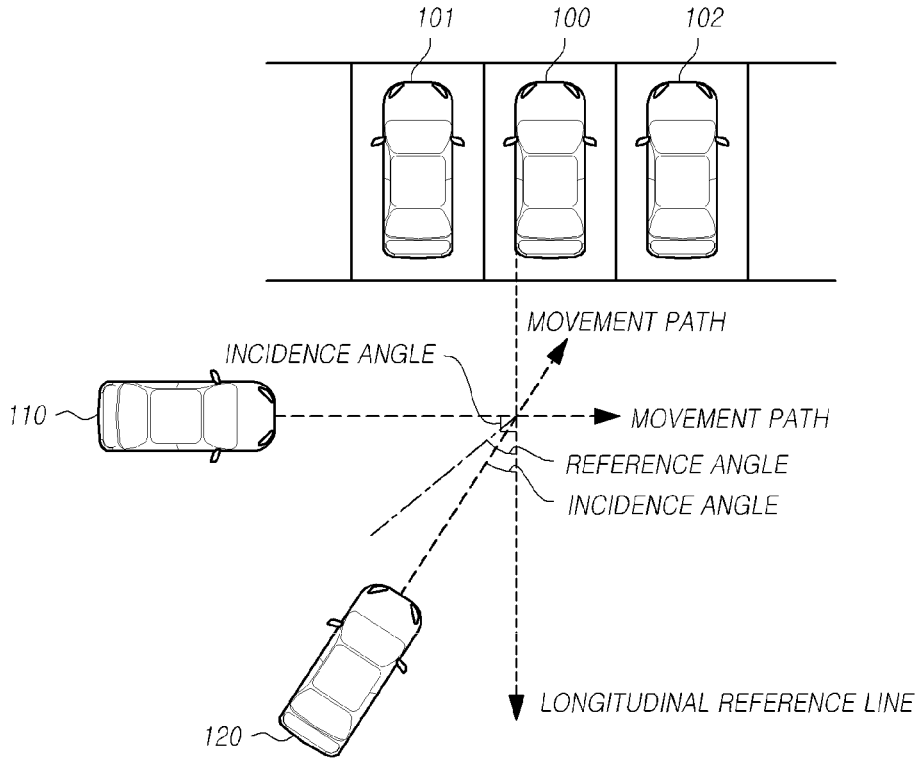
FIG. 1 is a diagram illustrating an operation of a rear cross traffic alert control apparatus in a perpendicular parking form.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompass all the meanings of the term "can".

A rear cross traffic alert control apparatus described here performs a role of detecting a rear side or a rear cross side of a vehicle and, in a case in which a target object satisfying a vehicle traffic alert condition is detected, notifying a driver of a traffic alert thereof. For example, the rear cross traffic alert control apparatus can detect a target object using a radar sensor and can detect a target object in accordance with a combination of sensing information acquired by one or more sensors configured inside or outside the vehicle such as a rider sensor, an ultrasonic sensor, or a camera sensor in addition to the radar sensor. There is no restriction on a method of detecting a target object using sensors of a vehicle.

Parking forms described here relate to forms in which a vehicle is parked and can be divided using an angle formed between a traveling road of a vehicle and the parked vehicle. For example, the parking form will be described as parallel parking in a case in which longitudinal directions of a traveling road and a parked vehicle are the same direction, and the parking form will be described as perpendicular parking in a case in which longitudinal directions of a traveling road and a parked vehicle form a right angle. In addition, in a case other than parallel parking and perpendicular parking in which a traveling road and a parked vehicle have a predetermined angle, the parking form will be described as diagonal parking. However, there is no restriction on the names of such parking forms.

A movement path described here will be described to have a meaning including not only a path along which another vehicle or a host vehicle moves but also a predicted future movement path of another vehicle or the host vehicle. For example, a movement path of another vehicle should be interpreted to include both a future movement path predicted in accordance with a position and a previous movement path of the another vehicle.

Hereinafter, a rear cross traffic alert control apparatus according to the present disclosure and a method thereof will be described with reference to the drawings.

FIG. 1 is a diagram illustrating an operation of the rear cross traffic alert control apparatus in a perpendicular parking form.

Referring to FIG. 1, it may be difficult for a vehicle 100 to secure a driver' sufficient field of vision in performing a vehicle exit operation due to parked surrounding vehicles 101 and 102 in the situation of perpendicular parking. Particularly, there is a problem in that it is difficult for a driver of the vehicle 100 to accurately recognize a moving vehicle 110 traveling in a vehicle exit space due to obstruction of the field of vision according to the vehicle 101.

In order to complement such a problem, the rear cross traffic alert control apparatus provides a function of detecting other vehicles 110 and 120 present on the rear cross side of the vehicle 100 and providing a traffic alert for a driver in a case in which the vehicle 100 performs a vehicle exit operation.

For example, in the case of the other vehicle 110 moving in a direction perpendicular to the parked vehicle 100, if there is a place at which a longitudinal reference line of the vehicle 100 and a predicted movement path of the other vehicle 110 meet, and an incidence angle formed by the longitudinal reference line and the predicted movement path is equal to or larger than a reference angle set in advance, the rear cross traffic alert control apparatus may recognize it as a traffic alert generation condition and notify the driver of dangerousness of the other vehicle 110.

However, in a case in which there is another vehicle 120 traveling by forming a predetermined angle with the parked vehicle 110, even if there is a place at which the longitudinal reference line and a predicted movement path of the other vehicle 120, in a case in which an incidence angle formed by the other vehicle 120 and the longitudinal reference line is detected as being smaller than a reference angle, the other vehicle 120 is excluded from the target and is excluded from the traffic alert generation condition.

The reason for this is that, in the case of the other vehicle 120 traveling with an incidence angle that is smaller than the reference angle, erroneous detection may occur in the rear cross traffic alert control apparatus, or there may be a limit in clear detection in accordance with relation with other vehicles parked on the opposite side. In addition, since a situation in which the other vehicle 120 moving with an incidence angle smaller than the reference angle can be sufficiently recognized by the driver of the vehicle 100 through a side mirror, a rear-view mirror, or the like is formed, the other vehicle 120 entering with an incidence angle smaller than the predetermined incidence angle is excluded from a target for a traffic alert from the point of view of improvement of reliability of the rear cross traffic alert control apparatus.

Figure 2:
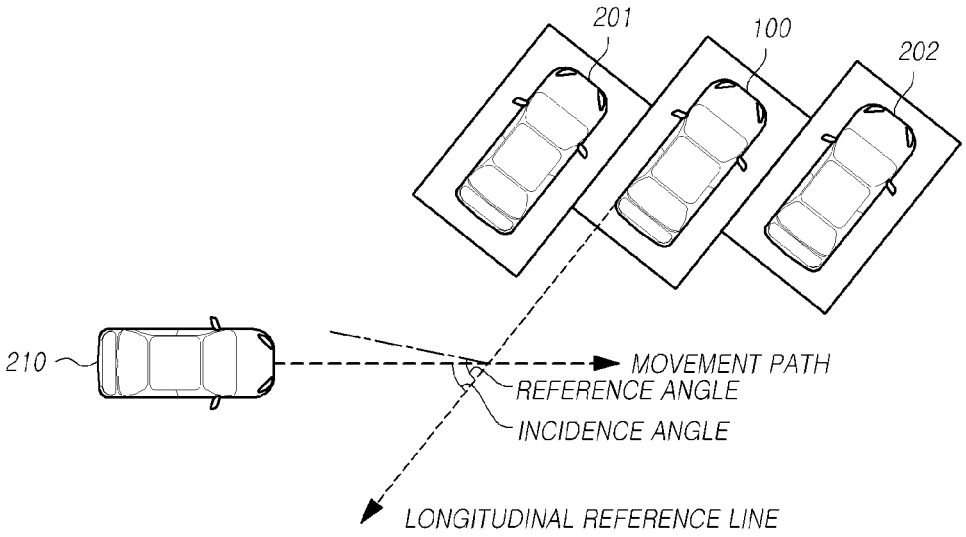
FIG. 2 is a diagram illustrating a problem of no detection of another vehicle in a conventional diagonal parking form.

FIG. 2 is a diagram illustrating a problem of no detection of another vehicle in a conventional diagonal parking form.

Referring to FIG. 2, as described with reference to FIG. 1, the rear cross traffic alert control apparatus of the vehicle 100 does not generate a traffic alert in a case in which the incidence angle of the other vehicle 210 is predicted to be smaller than the reference angle. This is for lowering an occurrence probability of erroneous detection and a non-detection problem and the like, whereby improvement of reliability can be provided for a driver.

However, as illustrated in FIG. 2, in a situation in which the vehicle 100 and the surrounding parking vehicles 201 and 202 are parked in a diagonal parking form, a problem in which a traffic alert is not generated in a case in which a determination result of comparison between the incidence angle and the reference angle described above is applied to generation/non-generation of a traffic alert may occur.

For example, in a case in which there is another vehicle 210 traveling in a lateral direction along a general traveling road, an incidence angle formed by the longitudinal reference line of the vehicle 100 and the movement path of the other vehicle 210 is detected to be smaller than the reference angle. This occurs due to inclination of the longitudinal reference line of the vehicle 100 according to diagonal parking, and the other vehicle 110 moving in the perpendicular parking form illustrated in FIG. 1 and the other vehicle 210 moving in the diagonal parking form are divided into a case in which the other vehicle is set as a traffic alert target (the case illustrated in FIG. 1) and a case in which the other vehicle is not set as a traffic alert target (the case illustrated in FIG. 2) even though they are along the same path.

Accordingly, in a case in which the vehicle 100 is parked in the diagonal parking form, a problem in which the other vehicle 210 to be detected as a traffic alert target cannot be detected may occur.

The present disclosure that has been proposed for solving the problems described above provides various embodiments in which the rear cross traffic alert control apparatus can accurately divide traffic alert targets and non-traffic alert targets efficiently regardless of the parking forms of vehicles.

Figure 3:
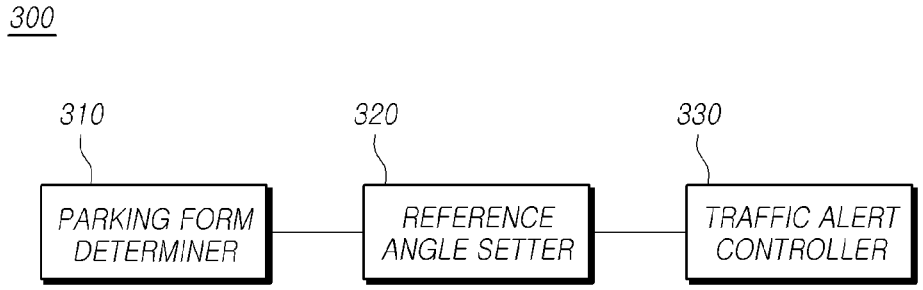
FIG. 3 is a diagram illustrating the configuration of a rear cross traffic alert control apparatus according to one embodiment.

FIG. 3 is a diagram illustrating the configuration of a rear cross traffic alert control apparatus according to one embodiment.

Referring to FIG. 3, the rear cross traffic alert control apparatus 300 may include: a parking form determiner 310 that determines a parking form of a vehicle using at least one of sensing information or parking space information; a reference angle setter 320 that sets a reference angle for controlling a rear cross traffic alert in accordance with the parking form 320; and a traffic alert controller 330 that controls generation/non-generation of a traffic alert using a result of comparison between an incidence angle, which is formed by a movement path of another vehicle detected inside a rear cross traffic alert area of a vehicle and a longitudinal reference line of the vehicle, and the reference angle if a rear cross traffic alert start condition of the vehicle is satisfied.

For example, the parking form determiner 310 may determine information relating to a parking form in which a vehicle is parked using at least one of sensing information composed inside or outside the vehicle or parking space information acquired at the time of parking the vehicle.

As one example, the parking form determiner 310 may determine the parking form of the vehicle as one of perpendicular parking, parallel parking, and diagonal parking using the parking space information acquired using a camera sensor at the time of performing a parking operation of the vehicle and further determine at least one of a diagonal direction or a diagonal angle information in a case in which the diagonal parking is determined.

Figure 4:
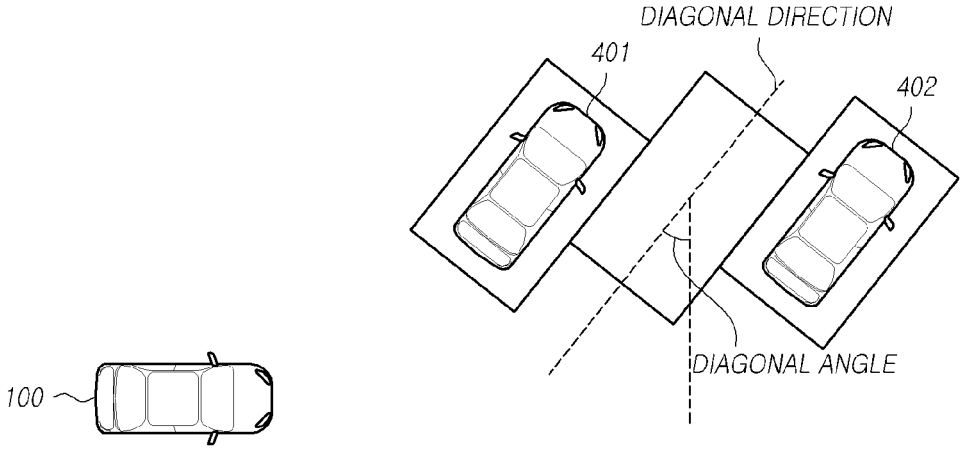
FIG. 4 is a diagram illustrating an operation for determining a parking form according to one embodiment.

Referring to FIG. 4, the vehicle 100 may search for a parking space for parking. For example, the vehicle 100 determine a parking space in which the vehicle 100 can be parked using at least one sensor among a radar sensor, a rider sensor, an ultrasonic sensor, and a camera sensor configured in the vehicle 100. In a case in which there are other vehicles 401 and 402, it may be determined whether the vehicle 100 can be parked by determining a size and a form of a parking space. Furthermore, the vehicle 100 may perform control of steering and a braking device of the vehicle 100 such that the vehicle 100 is automatedly parked in the determined parking space. In this way, if the vehicle 100 determines a parking space at the time of parking, parking space information thereof may be stored. The parking form determiner 310 may determine whether a parking form in which the vehicle 100 is parked is perpendicular parking, parallel parking or diagonal parking using the stored parking space information. Additionally, if it is determined that the vehicle 100 is parked in the diagonal parking form using the parking space information, the parking form determiner 310 may determine whether the parking space is diagonal to the left side or the right side with reference to a longitudinal direction of the vehicle. In addition, the parking form determiner 310 may further determine a diagonal angle formed by a perpendicular direction (a longitudinal direction of the vehicle at the time of performing perpendicular parking) of a traveling road and the diagonal direction. In other words, the parking form determiner 310 may determine whether a parking form in which the vehicle is parked is diagonal parking using parking space information determined at the time of parking.

Alternatively, the parking form determiner 310 may acquire a form of the parking space and diagonal direction and diagonal angle information using video information acquired by a camera sensor. For example, the parking space information acquired using a camera sensor may include intersection information of parking partition lines and parking partition line information included in the video information.

For example, the video information may include parking partition line information and intersection information of intersections at which parking partition lines intersect. When the intersection information is extracted, two or more parking partition lines forming intersections may be checked, and a parking form may be determined using angle information of angles formed by the parking partition lines. As one example, in a case in which an angle formed by two or more parking partitioning lines forming intersections is smaller than an angle set in advance, the parking form may be determined as diagonal parking. As another example, in a case in which an angle formed by two or more parking partitioning lines forming an intersection is within a predetermined range with reference to an angle set in advance, the parking space may be determined as perpendicular parking or parallel parking. Here, the angle set in advance may be set to a predetermined range with reference to 90 degrees. In a case in which the angle is set as a range, the parking form is determined based on whether an angle formed by parking partitioning lines deviates from the range.

On the other hand, the parking form determiner 310 may determine whether the parking form is diagonal parking using an angle formed by a direction of parking partition lines forming parking intersections determined in the process of scanning the parking space for parking that is performed by the vehicle 100 and a longitudinal direction of the scanning process of the vehicle 100. As illustrated in FIG. 4, an angle formed by the longitudinal direction of the vehicle and the parking partition lines in the process of checking a parking space performed by the vehicle 100 is neither parallel nor a right angle. Different from this, in the case of perpendicular parking or parallel parking, the longitudinal direction of the vehicle 100 and the parking partition lines are parallel to each other or form a right angle as a relative angle. Accordingly, in a case in which an angle formed by the direction of the parking partition lines and the longitudinal direction of the vehicle deviates from the predetermined range, the diagonal parking form may be determined.

In addition, if the parking form of the vehicle 100 is determined as diagonal parking, a diagonal direction or a diagonal angle of the parking space may be determined using the direction of the parking partition lines and the longitudinal direction of the vehicle 100.

As another example, the parking form determiner 310 may determine whether the parking form of the vehicle is the diagonal parking using a plurality of ultrasonic sensors of the vehicle and additionally determine at least one of the diagonal direction or the diagonal angle information in a case in which the diagonal parking is determined.

Figure 5:
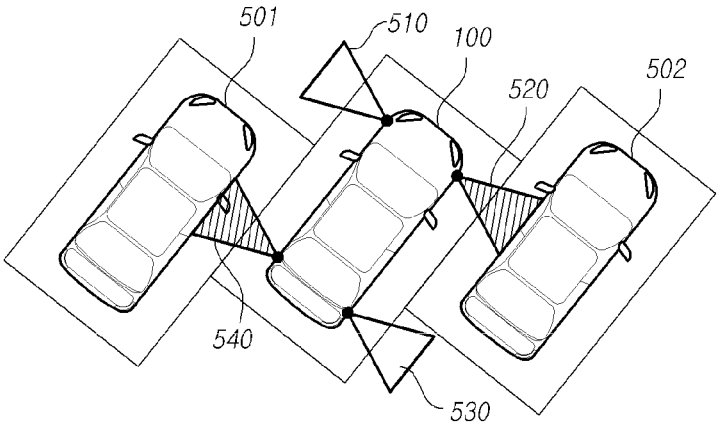
FIG. 5 is a diagram illustrating an operation for determining a parking form using sensing information according to another embodiment.

Referring to FIG. 5, in a case in which a vehicle 100 is parked, a parking form of the vehicle can be determined using a plurality of ultrasonic sensors configured in the vehicle 100. A case in which four ultrasonic sensors are configured in the vehicle 100 will be described with reference to FIG. 5. In a case in which the vehicle 100 is parked in the diagonal parking, an obstacle may be detected by only one ultrasonic sensor among front ultrasonic sensors of the vehicle 100. In other words, when a detection state of an ultrasonic sensor 510 and a detection state of an ultrasonic sensor 520 are compared with each other, although the detection state of the ultrasonic sensor 510 is determined to be in a non-detection state due to no detection of another vehicle 501, the detection state of the ultrasonic sensor 520 may be determined to be in a detection state due to detection of another vehicle 502.

In addition, in a case in which the vehicle 100 is parked in the diagonal parking, an obstacle may be detected by only one ultrasonic sensor among rear ultrasonic sensors of the vehicle 100. In other words, when a detection state of an ultrasonic sensor 530 and a detection state of an ultrasonic sensor 540 are compared with each other, although the detection state of the ultrasonic sensor 530 is determined to be in a non-detection state due to no detection of another vehicle 502, the detection state of the ultrasonic sensor 540 may be determined to be in a detection state due to detection of another vehicle 501.

In this way, in a case in which the detection state detected through an ultrasonic sensor occurs only on one side face on each of the front side and the rear side, and the front detection state and the rear detection state are on mutually-different side faces, the parking form determiner 310 may determine that the vehicle 100 is parked in the diagonal parking form. Additionally, in a case in which the vehicle is parked in the perpendicular parking, obstacles may be detected by all the four ultrasonic sensors or may be detected on the front side and the rear side on the same side face. In addition, in the case of parallel parking, an obstacle may be detected on the front side and the rear side on the same side face.

In this way, in a case in which obstacles positioned in the vicinity of the vehicle 100 are detected by ultrasonic sensors but are detected on only one side face on the front side and only one side face on the rear side, and the side faces on which the obstacles are detected on the front side and the rear side are different from each other, the parking form determiner 310 may determine diagonal parking.

Although ultrasonic sensors have been described above as an example, the description presented above may be similarly applied to the case of a sensor capable of detecting an obstacle such as a radar sensor, a rider sensor, a camera, or the like.

In addition, the parking form determiner 310 may recognize at least one of a diagonal direction or a diagonal angle of the vehicle using the position of a front ultrasonic sensor and the position of a rear ultrasonic sensor that have detected obstacles. For example, obstacles are detected by ultrasonic sensors 520 and 540 in a case in which a vehicle is parked in a rightward direction in the diagonal parking form as illustrated in FIG. 5, and obstacles are detected by ultrasonic sensors 510 and 530 in a case in which a vehicle is parked in a leftward direction in the diagonal parking form. In addition, the parking form determiner 310 may determine a diagonal angle using a distance to a detected obstacle, a form of an obstacle, an appearance of an obstacle, and the like.

As described with reference to FIGS. 4 and 5, the parking form determiner 310 may determine a parking form of a vehicle using various kinds of information, and FIGS. 4 and 5 may be applied individually or in combination. In other words, the parking form determiner 310 may perform determination basically based on parking space information and complementarily check sensing information acquired using ultrasonic sensors and the like. Alternatively, in a case in which any one type of information is missing, the parking form determiner 310 may use the other information with priority by raising the priority level thereof.

On the other hand, the reference angle setter 320 may dynamically set a reference angle for controlling a rear cross traffic alert in accordance with the parking form.

For example, in a case in which it is determined that the parking form is perpendicular parking or parallel parking, the reference angle setter 320 may set the reference angle to an initial angle set in advance. In other words, if it is determined that the vehicle is parked in the perpendicular parking form or the parallel parking form as a result of determination of the parking form determiner 310, the reference angle setter 320 may set an initial angle that is initially set in the vehicle as a reference angle.

Differently from this, in a case in which it is determined that the parking form of the vehicle is diagonal parking, the reference angle setter 320 may set a reference angle such that the initial angle is decreased by applying a diagonal factor to the initial angle. For example, in a case in which it is determined that the vehicle is parked in the diagonal parking form, in order to solve the problem due to non-detection, the reference angle setter 320 may set a reference angle such that the reference angle is smaller than the initial angle by applying a diagonal factor to the initial angle set in advance.

Here, the diagonal factor may be set in advance or be set in correspondence with diagonal angle information of the vehicle. For example, the diagonal factor may be set in advance using experiments, regulations, and the like and be stored in a storage device such as a memory or the like of the vehicle. In addition, the diagonal factor may be variably set in accordance with the state of the vehicle, a driver's input signal, and the like.

Alternatively, the diagonal factor may be dynamically set in correspondence with the diagonal angle information of the vehicle. For example, the value of the diagonal factor may be set such that it is in proportion to the diagonal angle of the vehicle. For this, a diagonal factor corresponding to the diagonal angle of the vehicle may be stored in a storage device such as a memory or the vehicle. Alternatively, a predetermined diagonal factor may be set in accordance with a diagonal angle range and be stored in a storage device of the vehicle. Alternatively, a reference diagonal factor value may be stored in a storage device of the vehicle, and a value of a ratio may be stored such that the value of the diagonal factor is increased at a predetermined ratio in accordance with a diagonal angle.

On the other hand, in a case in which it is determined that the parking form is diagonal parking, the reference angle setter 320 may set a reference angle of one side face of the vehicle to an initial angle based on the diagonal direction of the diagonal parking and set a reference angle of the other side face of the vehicle by applying a diagonal factor to the initial angle. For example, in a case in which it is determined that the parking form is the diagonal parking, a right diagonal direction is determined in a case in which a direction in which the vehicle deviates with reference to that of a case in which the vehicle is parked in the perpendicular parking form is the right side. Accordingly, in such a case, the reference angle setter 320 may set a reference angle of a right detection area on the rear side of the vehicle as an initial angle and set a reference angle of a left detection area to a reference angle acquired by applying a diagonal factor to the initial angle. The occurrence/non-occurrence of the problem described above is determined differently in accordance with the diagonal direction of the vehicle, and accordingly, this is for changing only the reference angle of a side face on which a problem occurs.

Alternatively, in a case in which it is determined that the parking form is the diagonal parking, the reference angle setter may set a reference angle by applying a diagonal factor to both initial angles of both side faces of the vehicle. Alternatively, when a reference angle is set by applying a diagonal factor to the initial angles of both the side faces, a diagonal factor may be determined to have a different value in accordance with the diagonal direction of the vehicle and be applied. For example, a diagonal factor having a larger value may be applied to a detection angle applied to a detection area on an opposite side in the diagonal direction, and a detection angle having a smaller value than that of the diagonal factor for the opposite side may be applied to a detection area in the same direction as the diagonal direction.

Meanwhile, if the rear cross traffic alert start condition of the vehicle is satisfied, the traffic alert controller 330 may control generation/non-generation of a traffic alert using a result of comparison between an incidence angle, which is formed by a movement path of another vehicle detected inside the rear cross traffic alert area of the vehicle and the longitudinal reference line of the vehicle, and the reference angle.

The rear cross traffic alert start condition of the vehicle may be determined in accordance with satisfaction/dissatisfaction of conditions set in advance such as an engine, a transmission, a vehicle speed, and the like of the vehicle. For example, in a case in which the vehicle is started, the transmission is set to reverse, and the vehicle speed is equal to or higher than a reference speed set in advance, it can be determined that the rear cross traffic alert start condition of the vehicle is satisfied. The rear cross traffic alert start condition of the vehicle performs a function starting role of the rear cross traffic alert control device.

The traffic alert controller 330 may perform control such that a rear cross traffic alert is generated in a case in which it is determined that the incidence angle is equal to or larger than the reference angle. For example, the traffic alert controller 330 may control generation/non-generation of a rear cross traffic alert using the reference angle set by the reference angle setter 320 and the incidence angle formed by a predicted movement path of another vehicle and the longitudinal reference line of the vehicle.

As one example, the traffic alert controller 330 may perform control such that a traffic alert is generated in a case in which the incidence angle is equal to or larger than the reference angle.

As another example, the traffic alert controller 330 may further determine a traffic alert generation condition that is additionally set in a case in which the incidence angle is equal to or larger than the reference angle and perform final control of generation/non-generation of a traffic alert. For example, the traffic alert controller 330 may perform control such that a rear cross traffic alert is generated by additionally determining whether an intersection at which the movement path of another vehicle and the longitudinal reference line of the vehicle intersect is present inside the rear cross traffic alert area, the relative speed of another vehicle is included in a range set in advance, and a predicted collision time between another vehicle and the vehicle is within a reference time. Here, the rear cross traffic alert area may be dynamically set in correspondence with the speed of the vehicle.

As described above, by dynamically setting the reference angle based on the parking form of the vehicle, the rear cross traffic alert control apparatus 300 can provide rear cross monitoring and a traffic alert that are the same and effective regardless of the parking form of the vehicle.

Hereinafter, the operation of the rear cross traffic alert control apparatus 300 described above will be described again with reference to FIG. 6.

Figure 6:
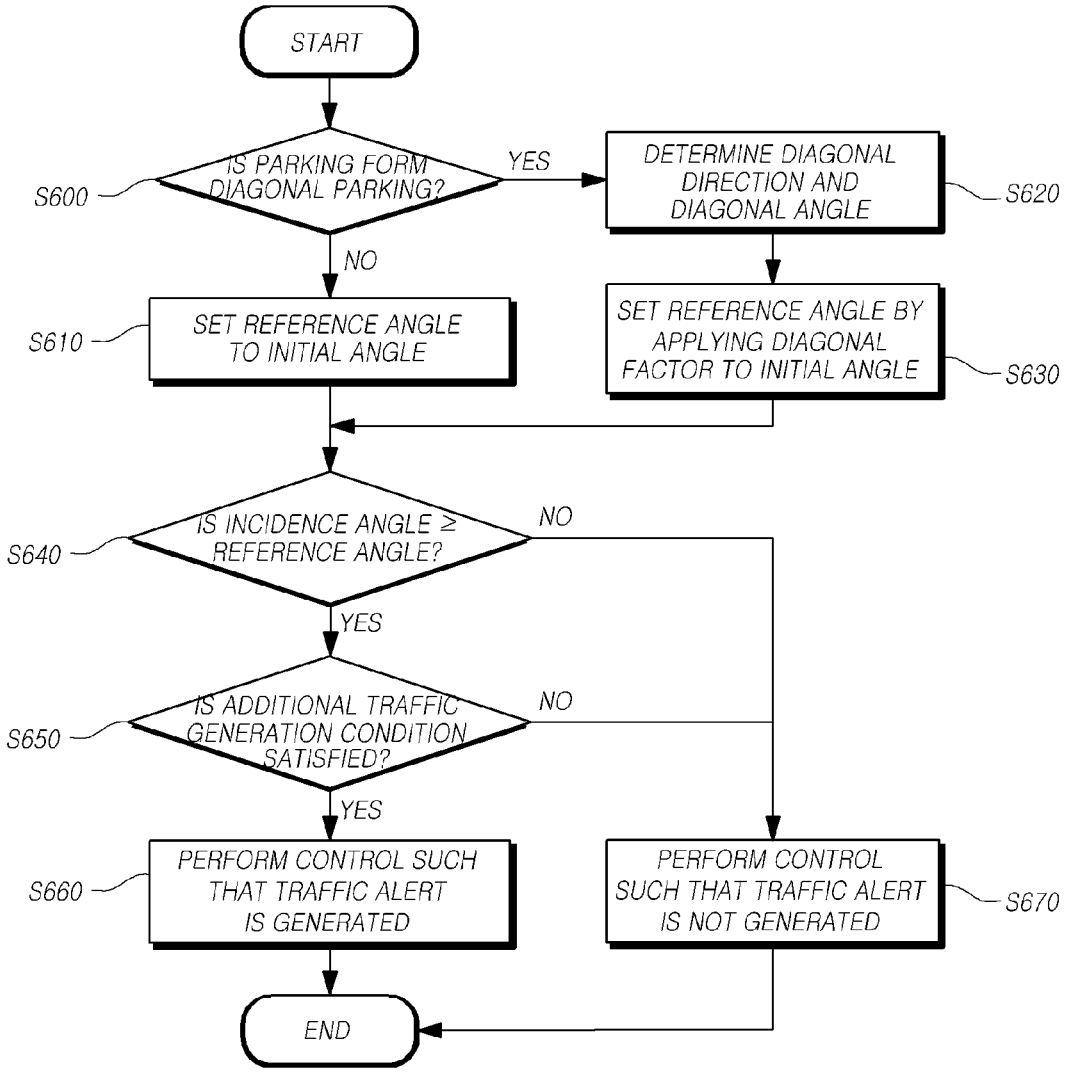
FIG. 6 is a diagram illustrating a reference angle setting operation of a rear cross traffic alert control apparatus according to one embodiment.

FIG. 6 is a diagram illustrating a reference angle setting operation of the rear cross traffic alert control apparatus according to one embodiment.

Referring to FIG. 6, the parking form determiner 310 of the vehicle determines whether or not the parking form of the vehicle is the diagonal parking using at least one of the parking space information or the sensing information described above (S600). In a case in which it is determined that the parking form of the vehicle is the diagonal parking, the parking form determiner 310 may further determine at least one of a diagonal direction or a diagonal angle (S620). As is necessary, Step S620 may be omitted. In a case in which Step S620 is omitted, in a case in which Step S600 is satisfied, an operation of Step S630 may be performed.

Thereafter, if it is determined that the parking form of the vehicle is not the diagonal parking, in other words, if the perpendicular parking or the parallel parking is determined, the reference angle setter 320 may set the reference angle to an initial angle set in advance (S610). On the other hand, in a case in which the parking form of the vehicle is the diagonal parking, the reference angle setter 320 may set the reference angle by applying a diagonal factor to the initial angle (S630). The traffic alert controller 330 determines whether the incidence angle is equal to or larger than the reference angle by comparing the reference angle set in accordance with the parking form of the vehicle with the incidence angle of another vehicle (S640). In a case in which the incidence angle is smaller than the reference angle, the traffic alert controller 330 determines that the traffic alert generation condition and performs control such that a traffic alert is not generated (S670). In a case in which the incidence angle is equal to or larger than the reference angle, the traffic alert controller 340 determines whether an additional traffic alert generation condition (S650). In a case in which the additional traffic alert generation condition is not satisfied, the traffic alert controller 330 performs control such that a traffic alert is not generated (S670).

On the other hand, in a case in which the additional traffic alert generation condition is satisfied as well, the traffic alert controller 330 may perform control such that a traffic alert is generated (S660). The additional traffic alert generation condition will be described in more detail with reference to FIG. 7.

Figure 7:
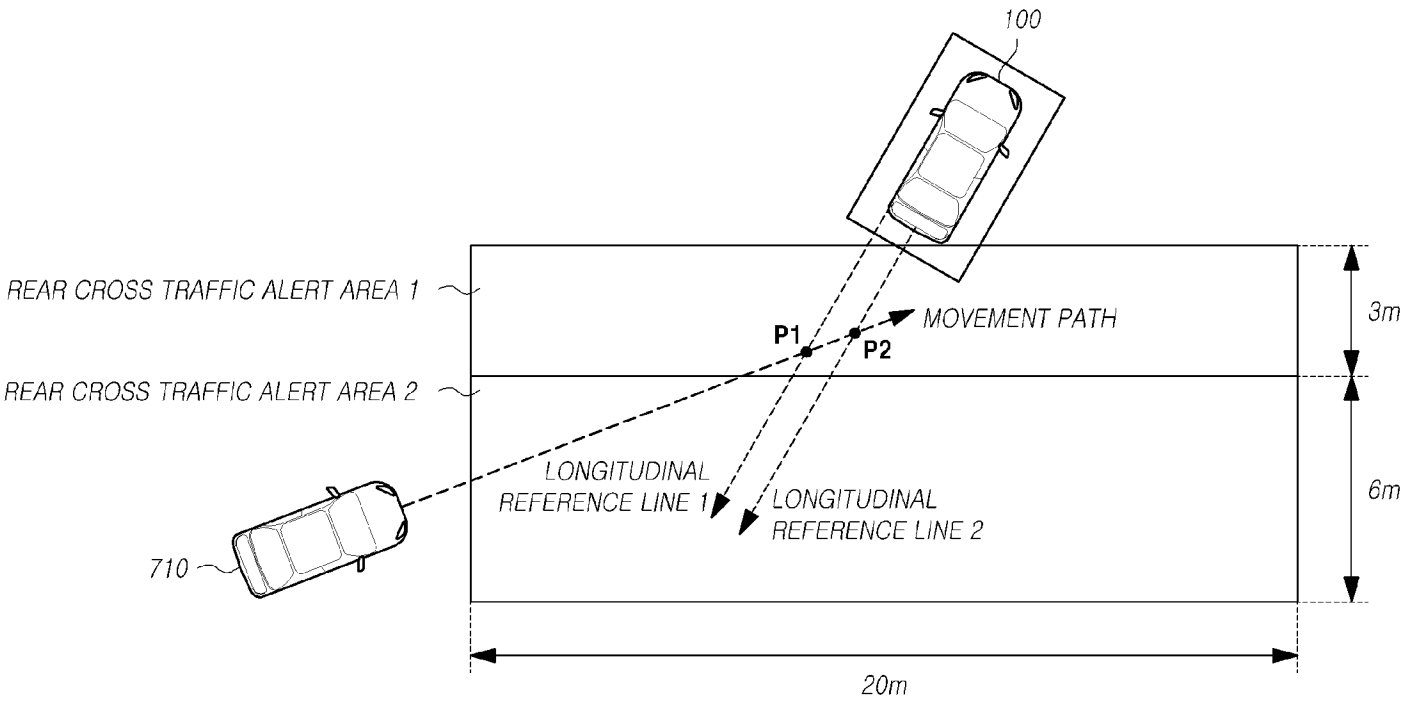
FIG. 7 is a diagram illustrating an additional condition for determining generation/non-generation of a traffic alert according to one embodiment.

FIG. 7 is a diagram illustrating an additional condition for determining generation/non-generation of a traffic alert according to one embodiment.

Referring to FIG. 7, the rear cross traffic alert control apparatus 300 of the vehicle 100 determines a place P1 at which a predicted movement path of another vehicle 710 and the longitudinal reference line 1 of the vehicle meet. The longitudinal reference line of the vehicle is set with reference to an end line of the vehicle 100 in a direction in which another vehicle 710 approaches and may be set like the longitudinal reference line 1 or may be set like a longitudinal reference line 2 by extending the center line of the vehicle 100. In a case in which the longitudinal reference line 2 is set, the rear cross traffic alert control apparatus 300 may determine a place P2 at which a predicted movement path of another vehicle 710 and the longitudinal reference line 2 meet.

The rear cross traffic alert control apparatus 300 determines whether there is the place P1 or P2 inside the rear cross traffic alert area. The rear cross traffic alert area may be dynamically set in correspondence with the speed of the vehicle 100. For example, the rear cross traffic alert area may be set like the rear cross traffic alert area 1 in a case in which the speed of the vehicle is lower than the reference speed, and the rear cross traffic alert area may be set to be extended like the rear cross traffic alert area 2 in a case in which the speed of the vehicle is equal to or higher than the reference speed.

Alternatively, two or more rear cross traffic alert areas may be set to have a plurality of distances with reference to the vehicle 100, and a type of control signal for controlling a rear cross traffic alert may be generated differently for each rear cross traffic alert area. For example, as rear cross traffic alert areas, the rear cross traffic alert area 1 and the rear cross traffic alert area 2 may be set. In a case in which another vehicle 710 enters the rear cross traffic alert area 2 and satisfies a traffic alert condition to be described below, the rear cross traffic alert control apparatus 300 may generate traffic alert control signals such that various traffic alerts using sight, hearing, and the like are performed for a driver. On the other hand, in a case in which another vehicle 710 enters the rear cross traffic alert area 1 and satisfies a traffic alert condition to be described below, the rear cross traffic alert control apparatus 300 may generate a braking control signal for causing the vehicle 100 to stop. In other words, the rear cross traffic alert control apparatus 300 may set a plurality of rear cross traffic alert areas for a rear cross traffic alert and generate control signals such that a traffic alert, braking control, avoidance control, and the like are sequentially performed in accordance with a traffic alert area that another vehicle has entered. Through this, enforced braking is performed in a case in which urgent braking of the vehicle is necessary while minimizing driver's sense of strangeness, and the safety of the driver can be improved. The number of set rear cross traffic alert areas, the sizes of the areas, and the like may be variously set, and there is no restriction thereon.

In addition, if it is determined that the intersection P1 or P2 at which the predicted movement path of another vehicle 710 and the longitudinal reference line of the vehicle 100 intersect is positioned inside the rear cross traffic alert area, the rear cross traffic alert control apparatus 300 determines whether a relative speed between the vehicle 100 and another vehicle 710 is included in a speed range set in advance. Additionally, the rear cross traffic alert control apparatus 300 may determine that the condition is satisfied only in a case in which the relative speed has a positive value (in other words, in a case in which another vehicle 710 approaches in the direction of the vehicle 100).

Figure 8:
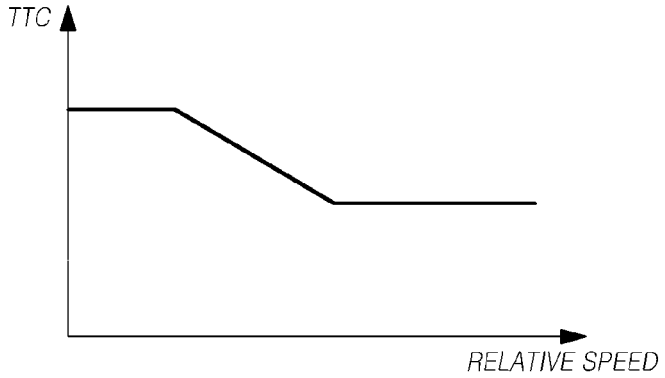
FIG. 8 is a diagram illustrating an operation of setting a predicted collision time according to one embodiment.

In addition, the rear cross traffic alert control apparatus 300 may determine a predicted collision time between the vehicle 100 and another vehicle 710 using the position information and the relative speed information of the vehicle 100 and another vehicle 710. The predicted collision time may be determined in accordance with a table set in advance in correspondence with the relative speed as illustrated in FIG. 8. As one example, the predicted collision time may be determined as a value acquired by dividing a relative distance between the vehicle 100 and another vehicle 710 by the relative speed.

The additional condition described above may be added or omitted as is necessary. In a case in which an additional condition is set, the traffic alert controller 330 may perform control such that a traffic alert is generated only in a case in which the additional condition is satisfied, and the incidence angle is equal to or larger than the reference angle.

Figure 9:
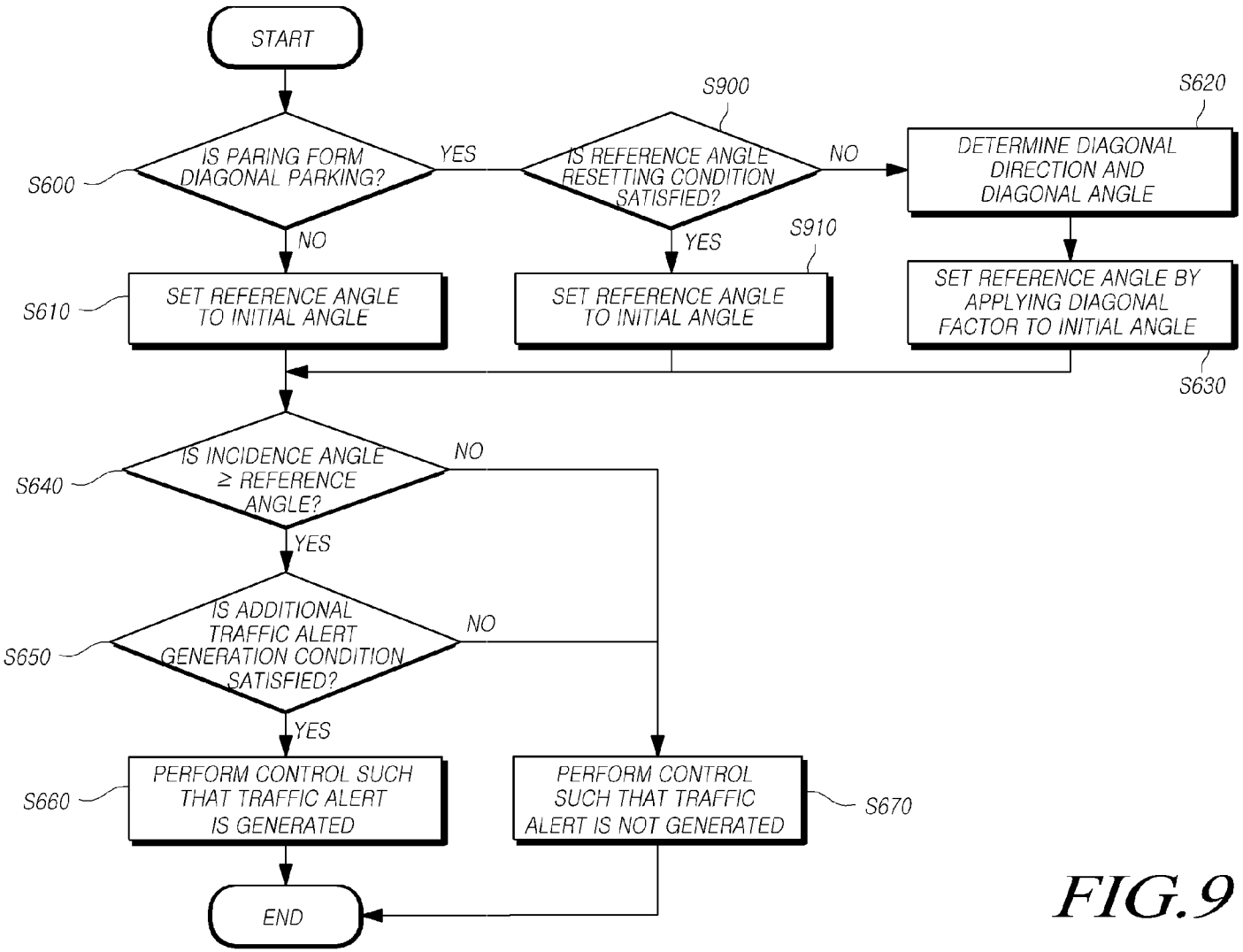
FIG. 9 is a diagram illustrating an operation of determining resetting/non-resetting of a reference angle performed by a rear cross traffic alert control apparatus according to one embodiment.

FIG. 9 is a diagram illustrating an operation of determining resetting/non-resetting of a reference angle performed by a rear cross traffic alert control apparatus according to one embodiment.

Referring to FIG. 9, Steps S600 to S670 are the same as the operations illustrated in FIG. 6 described above, and thus description thereof will be omitted here.

However, the reference angle setter 320 may determine resetting/non-resetting of a reference angle of the vehicle using at least one of a movement distance after completion of parking of the vehicle or the vehicle information. For example, the reference angle setter 320 may additionally determine whether a reference angle resetting condition is satisfied in a case in which the parking form of the vehicle is the diagonal parking (S900). The reference angle setter 320 performs Step S620 in a case in which the reference angle resetting condition is not satisfied and sets the reference angle to the initial angle in a case in which the reference angle resetting condition is satisfied (S910). The satisfaction/dissatisfaction of the reference angle resetting condition may be determined using a case in which the vehicle moves a reference distance set in advance or more after completion of parking of the vehicle, or the vehicle speed of the vehicle is equal to or higher than the reference speed.

In a case in which information of a parking space is retrieved at the time of parking the vehicle, and parking space information is stored as the diagonal parking, the vehicle may be moved to another place for an arbitrary reason. For example, a vehicle may be moved from a diagonal parking space to a perpendicular parking space due to towing or the like. Accordingly, in such a case, a problem may occur in a case in which the reference angle is applied by changing the parking space information described above using the parking space information described above.

In order to prevent such a problem, the reference angle setter 320 may determine resetting/non-resetting of the reference angle by determining whether the vehicle has moved a predetermined distance or a predetermined speed or more has occurred after the completion of parking of the vehicle.

As described above, the rear cross traffic alert control apparatus according to the present disclosure may dynamically change the reference angle in accordance with the parking state of the vehicle.

Figure 10:
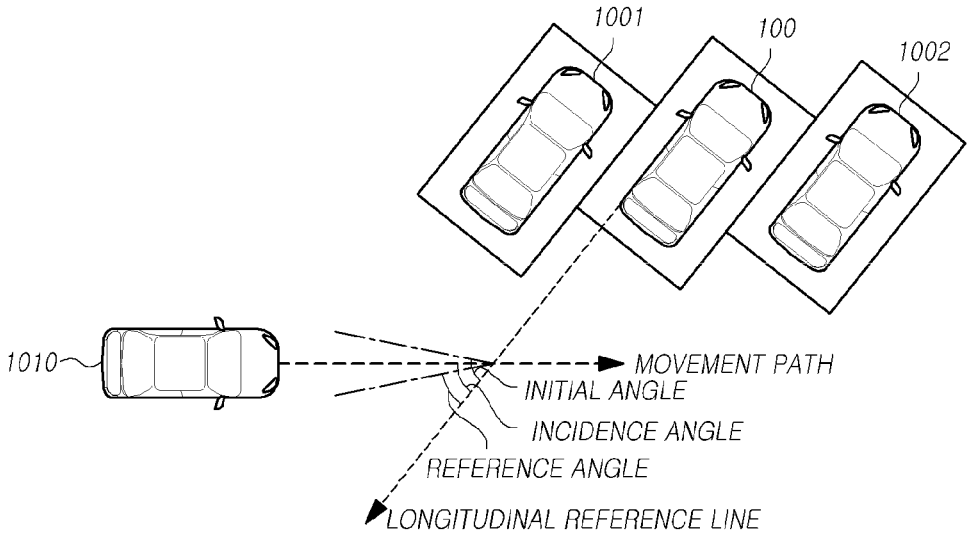
FIG. 10 is a diagram illustrating an operation of detecting another vehicle, which is performed by a rear cross traffic alert control apparatus according to one embodiment, even in the situation of diagonal parking.

FIG. 10 is a diagram illustrating an operation of detecting another vehicle, which is performed by a rear cross traffic alert control apparatus according to one embodiment, even in the situation of diagonal parking.

Referring to FIG. 10, a rear cross traffic alert function may be requested in a case in which a vehicle 100 is parked between other vehicles 1001 and 1002. If an initial angle set in advance and an incidence angle are considered without a parking form of vehicles considered, the incidence angle of the other vehicle 1010 that is to be a target for a traffic alert appears to be smaller than the initial angle, and thus, a traffic alert may not be generated.

However, in a case in which the parking form of vehicles is determined to be diagonal parking, the rear cross traffic alert control apparatus 300 sets the reference angle by applying a diagonal factor to the initial angle, and accordingly, the incidence angle of the other vehicle 1010 is determined to be larger than the reference angle, and a traffic alert can be generated.

In this way, according to the present disclosure, the same rear cross traffic alert function is provided for a driver regardless of the parking form of vehicles regardless of the parking form of vehicles, and accordingly, the reliability for the driver can be improved.

In addition, the rear cross traffic alert control apparatus may include a parking form determiner that determines whether a parking form of a vehicle is diagonal parking using sensing information or parking space information received through camera sensors or ultrasonic sensors and a controller that controls generation/non-generation of a rear cross traffic alert using information of an angle formed by a movement path of another vehicle detected inside a rear cross traffic alert area of the vehicle and a vehicle exit path formed in a case in which the vehicle exits if the parking form of the vehicle is determined to be diagonal parking, and a rear cross traffic alert start condition of the vehicle is satisfied. Here, the controller may perform some or all of the operations of the reference angle setter and the traffic alert controller described above.

For example, the controller may determine generation/non-generation of a rear cross traffic alert in accordance with a result of comparison between the information of the angle, which is formed by the movement path of another vehicle and the vehicle exit path formed in a case in which the vehicle exits, and the reference angle. Here, the reference angle may be set to be smaller than the initial angle set in a case in which the vehicle is in the state of parallel parking or perpendicular parking, and the diagonal factor described above may be used.

In addition, the controller may perform some or all of the operations required for performing the present disclosure described above As described above, the rear cross traffic alert control apparatus 300 according to the present disclosure can provide an accurate and safe rear cross traffic alert function for a driver by dynamically changing the reference angle in accordance with the parking state of the vehicle. Hereinafter, a method for controlling a rear cross traffic alert capable of performing all or some of the embodiments described above will be described with reference to the drawings.

Figure 11:
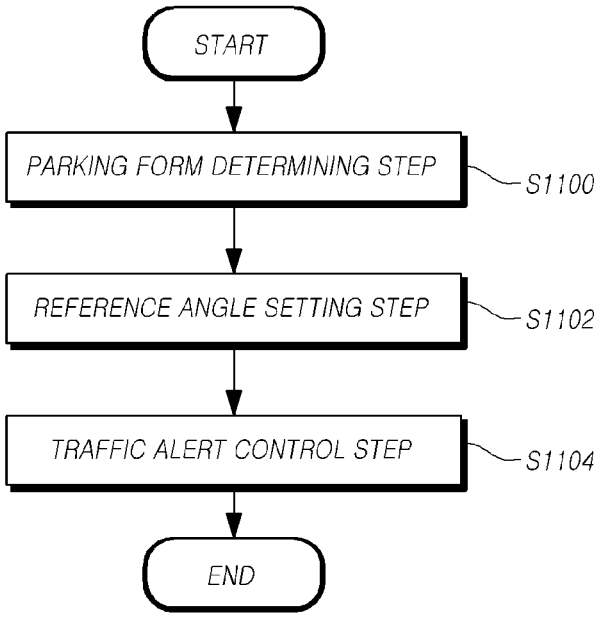
FIG. 11 is a flowchart illustrating a method for controlling a rear cross traffic alert according to one embodiment.

FIG. 11 is a flowchart illustrating a method for controlling a rear cross traffic alert according to one embodiment.

Referring to FIG. 11, the method for controlling a rear cross traffic alert may include a parking form determining step of determining a parking form of a vehicle using at least one of sensing information or parking space information (S1100). As described above, the parking form determining step may determine the parking form of a vehicle to be one of perpendicular parking, parallel parking, and diagonal parking and may further determine at least one of a diagonal direction or diagonal angle information in a case in which the diagonal parking is determined. The parking form of a vehicle may be determined using parking space information retrieved at the time parking the vehicle. Alternatively, the parking form of a vehicle may be determined using sensing information acquired by sensors (for example, ultrasonic sensors) configured in the vehicle. Alternatively, the parking form may be determined by using both the parking space information and the sensing information through selective use according to priority levels or included types of information.

In addition, the method for controlling a rear cross traffic alert may include a reference angle setting step of setting a reference angle for controlling a rear cross traffic alert in accordance with the parking form (S1102). In the reference angle setting step, the reference angle may be set to an initial angle set in advance in a case in which it is determined that the parking form is the perpendicular parking or the parallel parking, and the reference angle may be set such that the initial angle is decreased by applying a diagonal factor to the initial angle in a case in which it is determined that the parking form is the diagonal parking. As described above, the diagonal factor may be set in advance or be set in correspondence with the diagonal angle information of the vehicle. In addition, in the reference angle setting step, in a case in which it is determined that the parking form is the diagonal parking, a reference angle of one side face of the vehicle may be set to the initial angle based on the diagonal direction of the diagonal parking and may set a reference angle of the other side face of the vehicle by applying a diagonal factor to the initial angle. The side face for which the reference angle is set to the initial angle may be determined in accordance with the diagonal direction of the vehicle.

On the other hand, in the reference angle setting step, resetting/non-resetting of the reference angle of the vehicle may be determined using at least one of a movement distance after the completion of parking of the vehicle or vehicle speed information.

In addition, the method of controlling a rear cross traffic alert may include a traffic alert control step of controlling generation/non-generation of a traffic alert using a result of comparison between an incidence angle, which is formed by a movement path of another vehicle detected inside a rear cross traffic alert area of the vehicle and a longitudinal reference line of the vehicle, and the reference angle if a rear cross traffic alert start condition of the vehicle is satisfied (S1104). In the traffic alert control step, a rear cross traffic alert may be controlled to be generated in a case in which it is determined that the incidence angle is equal to or larger than the reference angle. Alternatively, in the traffic alert control step, generation/non-generation of a traffic alert may be controlled by additionally determining an additional traffic alert generation condition. For example, in the traffic alert control step, a rear cross traffic alert may be controlled to be generated by additionally determining whether an intersection at which the movement path of another vehicle and the longitudinal reference line of the vehicle intersect is present inside the rear cross traffic alert area, the relative speed of another vehicle is included in a range set in advance, and a predicted collision time between another vehicle and the vehicle is within a reference time. As is necessary, the rear cross traffic alert area may be dynamically set in correspondence with the speed of the vehicle.

In addition, the method for controlling a rear cross traffic alert may further include steps for stepwise performing the operations described with reference to FIGS. 1 to 10, and some steps may be omitted, or the order thereof may be changed.

As described above, the present disclosure performs control such that a rear cross traffic alert is generated using the same criterion regardless of a change of the parking form of the vehicle and provides an effect of improving the safety and reliability of a driver.

The above description has been presented to enable any person skilled in the art to make and use the technical idea of the present disclosure, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the present disclosure. The above description and the accompanying drawings provide an example of the technical idea of the present disclosure for illustrative purposes only. That is, the disclosed embodiments are intended to illustrate the scope of the technical idea of the present disclosure. Thus, the scope of the present disclosure is not limited to the embodiments shown, but is to be accorded the widest scope consistent with the claims. The scope of protection of the present disclosure should be construed based on the following claims, and all technical ideas within the scope of equivalents thereof should be construed as being included within the scope of the present disclosure.

What is claimed is:

1. A rear cross traffic alert control apparatus comprising:

a parking form determiner that determines a parking form of a vehicle using at least one of sensing information or parking space information;

a reference angle setter that sets a reference angle for controlling a rear cross traffic alert in accordance with the parking form; and a traffic alert controller that controls generation/non-generation of a traffic alert using a result of comparison between an incidence angle, which is formed by a movement path of another vehicle detected inside a rear cross traffic alert area of the vehicle and a longitudinal reference line of the vehicle, and the reference angle if a rear cross traffic alert start condition of the vehicle is satisfied.

2. The rear cross traffic alert control apparatus according to claim 1, wherein the parking form determiner determines the parking form of the vehicle to be one of perpendicular parking, parallel parking, and diagonal parking using the parking space information acquired using camera sensors at the time of performing a parking operation of the vehicle and further determines at least one of a diagonal direction or diagonal angle information in a case in which the diagonal parking is determined.

3. The rear cross traffic alert control apparatus according to claim 2, wherein the parking space information acquired using the camera sensors includes intersection information of parking partitioning lines and information of an angle formed by the parking partition lines configuring the intersections, and wherein the parking form determiner determines that the parking form is the diagonal parking in a case in which the angle formed by the parking partition lines is smaller than an angle set in advance.

4. The rear cross traffic alert control apparatus according to claim 1, wherein the parking form determiner determines whether the parking form of the vehicle is the diagonal parking using a plurality of ultrasonic sensors of the vehicle and additionally determines at least one of a diagonal direction or diagonal angle information in a case in which the diagonal parking is determined.

5. The rear cross traffic alert control apparatus according to claim 4, wherein the parking form determiner determines that the parking form of the vehicle is the diagonal parking in a case in which an obstacle is detected by any one of front ultrasonic sensors of the vehicle, an obstacle is detected by any one of rear ultrasonic sensors of the vehicle, and the ultrasonic sensors that have detected the obstacles are positioned on mutually different side faces.

6. The rear cross traffic alert control apparatus according to claim 1, wherein the reference angle setter sets the reference angle to an initial angle set in advance in a case in which it is determined that the parking form is the perpendicular parking or the parallel parking and sets the reference angle such that the initial angle is decreased by applying a diagonal factor to the initial angle in a case in which it is determined that the parking form is the diagonal parking.

7. The rear cross traffic alert control apparatus according to claim 6, wherein, in a case in which it is determined that the parking form is the diagonal parking, the reference angle setter sets the reference angle of one side face of the vehicle to the initial angle based on the diagonal direction of the diagonal parking and sets the reference angle of the other side face of the vehicle by applying the diagonal factor to the initial angle.

8. The rear cross traffic alert control apparatus according to claim 6, wherein the diagonal factor is set in advance or is variably set in correspondence with the diagonal angle information of the vehicle.

9. The rear cross traffic alert control apparatus according to claim 1, wherein the traffic alert controller performs control such that the rear cross traffic alert is generated in a case in which it is determined that the incidence angle is equal to or larger than the reference angle.

10. The rear cross traffic alert control apparatus according to claim 9, wherein the traffic alert controller performs control such that the rear cross traffic alert is generated by additionally determining whether an intersection at which the movement path of the another vehicle and the longitudinal reference line of the vehicle intersect is present inside the rear cross traffic alert area, a relative speed of the another vehicle is included in a range set in advance, and a predicted collision time between the another vehicle and the vehicle is within a reference time.

11. The rear cross traffic alert control apparatus according to claim 9, wherein the rear cross traffic alert area is dynamically set in correspondence with a speed of the vehicle.

12. The rear cross traffic alert control apparatus according to claim 9, wherein two or more rear cross traffic alert areas are set to have a plurality of distances with reference to the vehicle, and a type of control signal used for controlling a rear cross traffic alert is generated differently for each of the rear cross traffic alert areas.

13. The rear cross traffic alert control apparatus according to claim 1, wherein the reference angle setter determines resetting/no-resetting of the reference angle of the vehicle using at least one of a movement distance after completion of parking of the vehicle or vehicle speed information.

14. The rear cross traffic alert control apparatus according to claim 13, wherein the reference angle of the vehicle is reset to the initial angle set in advance in a case in which the movement distance is equal to or longer than a reference distance, or the vehicle speed information is equal to or higher than a reference speed.

15. A method for controlling a rear cross traffic alert, the method comprising:

a parking form determining step of determining a parking form of a vehicle using at least one of sensing information or parking space information;

a reference angle setting step of setting a reference angle for controlling a rear cross traffic alert in accordance with the parking form; and a traffic alert control step of controlling generation/non-generation of a traffic alert using a result of comparison between an incidence angle, which is formed by a movement path of another vehicle detected inside a rear cross traffic alert area of the vehicle and a longitudinal reference line of the vehicle, and the reference angle if a rear cross traffic alert start condition of the vehicle is satisfied.

16. The method according to claim 15, wherein, in the parking form determining step, the parking form of the vehicle is determined to be one of perpendicular parking, parallel parking, and diagonal parking, and at least one of a diagonal direction or diagonal angle information is further determined in a case in which the diagonal parking is determined.

17. The method according to claim 15, wherein, in the reference angle setting step, the reference angle is set to an initial angle set in advance in a case in which it is determined that the parking form is the perpendicular parking or the parallel parking, and the reference angle is set such that the initial angle is decreased by applying a diagonal factor to the initial angle in a case in which it is determined that the parking form is the diagonal parking.

18. The method according to claim 15, wherein, in the traffic alert control step, the rear cross traffic alert is controlled to be generated in a case in which it is determined that the incidence angle is equal to or larger than the reference angle.

19. A rear cross traffic alert control apparatus comprising:

a parking form determiner that determines whether a parking form of a vehicle is diagonal parking using sensing information received through camera sensors or ultrasonic sensors or parking space information; and a controller that:

controls generation/non-generation of a rear cross traffic alert using information of an angle formed by a movement path of another vehicle detected inside a rear cross traffic alert area of the vehicle and a vehicle exit path formed in a case in which the vehicle exits if the parking form of the vehicle is determined to be the diagonal parking, and a rear cross traffic alert start condition of the vehicle is satisfied, and compares the angle, which is formed by the movement path of the another vehicle and the vehicle exit path, with a reference angle, which is set for controlling the rear cross traffic alert in accordance with the parking form.

20. The rear cross traffic alert control apparatus according to claim 19, wherein the controller determines generation/non-generation of the rear cross traffic alert in accordance with a result of comparison between the angle formed by the movement path of the another vehicle and the vehicle exit path and the reference angle, and wherein the reference angle is set to be smaller than an initial angle set in a case in which the vehicle is in a parallel parking state or a perpendicular parking state.

* * * * *